United States Patent [19]

Waller

[11] Patent Number: 4,932,184

[45] Date of Patent: Jun. 12, 1990

[54] ROOFING PANEL

[75] Inventor: Michael B. Waller, Brea, Calif.

[73] Assignee: Gerard Tile, Inc., Brea, Calif.

[21] Appl. No.: 319,532

[22] Filed: Mar. 6, 1989

[51] Int. Cl.[5] ..... E04D 1/26; B44F 9/02

[52] U.S. Cl. ..... 52/535; 52/542; 52/555

[58] Field of Search ..... 52/519, 533, 534, 536, 52/537, 538, 558, 313, 314, 478, 535, 554, 555, 542

[56] References Cited

U.S. PATENT DOCUMENTS

| | | | |
|---|---|---|---|
| 1,255,280 | 2/1918 | Beck | 52/537 X |
| 2,211,508 | 8/1940 | Little | 52/533 |
| 3,809,598 | 5/1974 | Ferguson | 52/555 X |
| 3,977,141 | 8/1976 | Peters | 52/534 |
| 3,983,675 | 10/1976 | Pearse | 52/533 |
| 4,015,392 | 4/1977 | Eaton | 52/555 X |
| 4,130,974 | 12/1978 | Chalmers | 52/555 X |
| 4,189,889 | 2/1980 | Yanoh | 52/533 X |
| 4,343,126 | 8/1982 | Hoofe | 52/314 X |
| 4,468,909 | 9/1984 | Eaton | 52/555 X |
| 4,617,773 | 10/1986 | Studwell | 52/537 |

OTHER PUBLICATIONS

Publication by Gerard Tile, Inc., entitled "Stone/Steel Roof Tile, The Ultimate in Roof Technology", 1986.

Publication by Gerard Tile, Inc., entitled "When You're Under the Weather . . . ", 1989.

*Primary Examiner*—Carl D. Friedman
*Assistant Examiner*—Jerrold D. Johnson
*Attorney, Agent, or Firm*—Knobbe, Martens, Olson & Bear

[57] ABSTRACT

Disclosed is a panel for installation with similar adjacent top, bottom and side panels to form a roof having the appearance of a wooden shake roof. The panel has a generally rectangular panel body with an irregular surface of generally trapezoidal shake-like modules of different heights and widths, which surface is symmetrical only about the lateral center line of the panel. The modules at the ends of the panel body are configured to overlap with an end module of an adjacent side panel. The panel also features a nose flange extending downwardly from the front edge of the panel body which is irregularly configured so that the nose flange bottom edge is adapted to abut the panel body of an adjacent bottom panel. A rear upstand extends upwardly from the rear edge of the panel body and is irregularly configured so that the front surface of the rear upstand is adapted to mate with the nose flange rear surface of an adjacent top panel. Extending rearwardly from the top edge of the rear upstand is a back flange which is irregularly configured so that its top surface is adapted to mate with the bottom surface of the panel body of an adjacent top panel.

23 Claims, 3 Drawing Sheets

Fig. 1
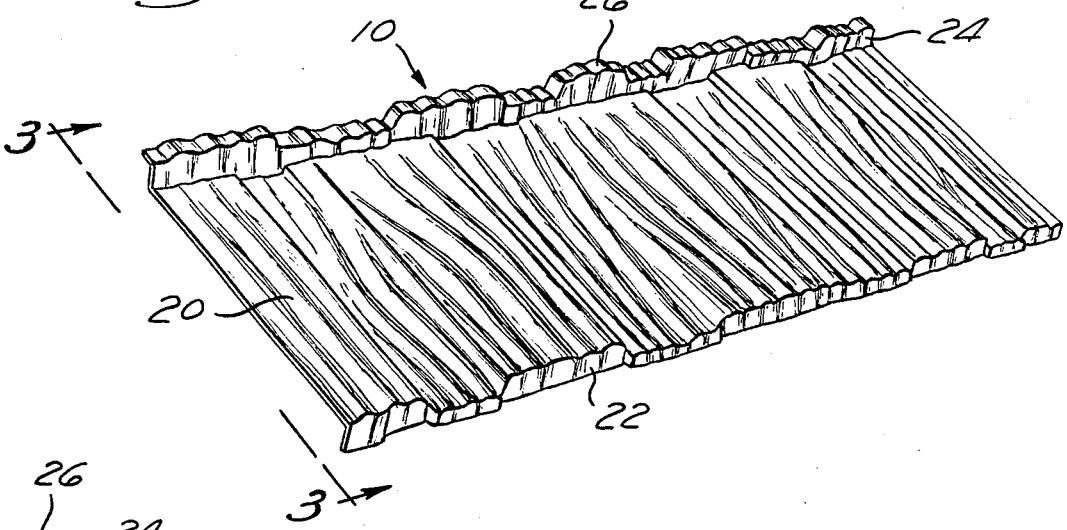
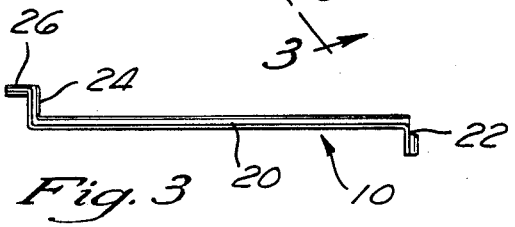
Fig. 3
Fig. 2
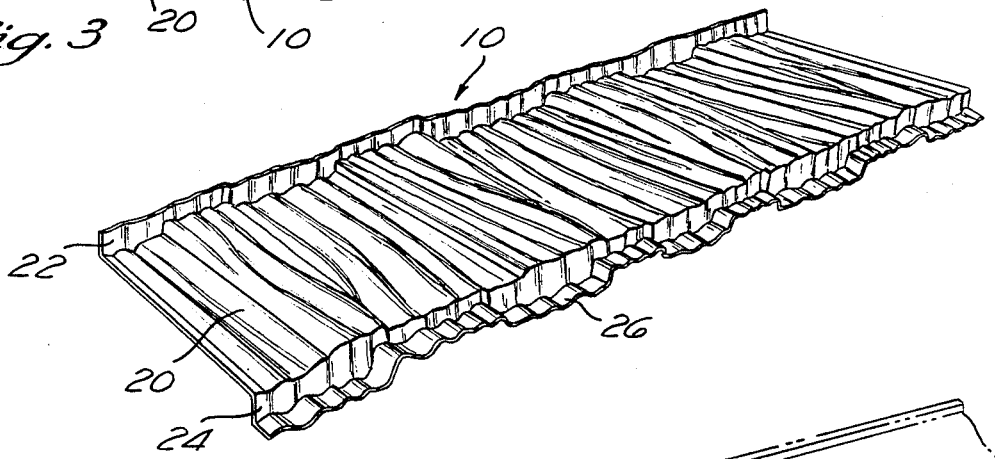
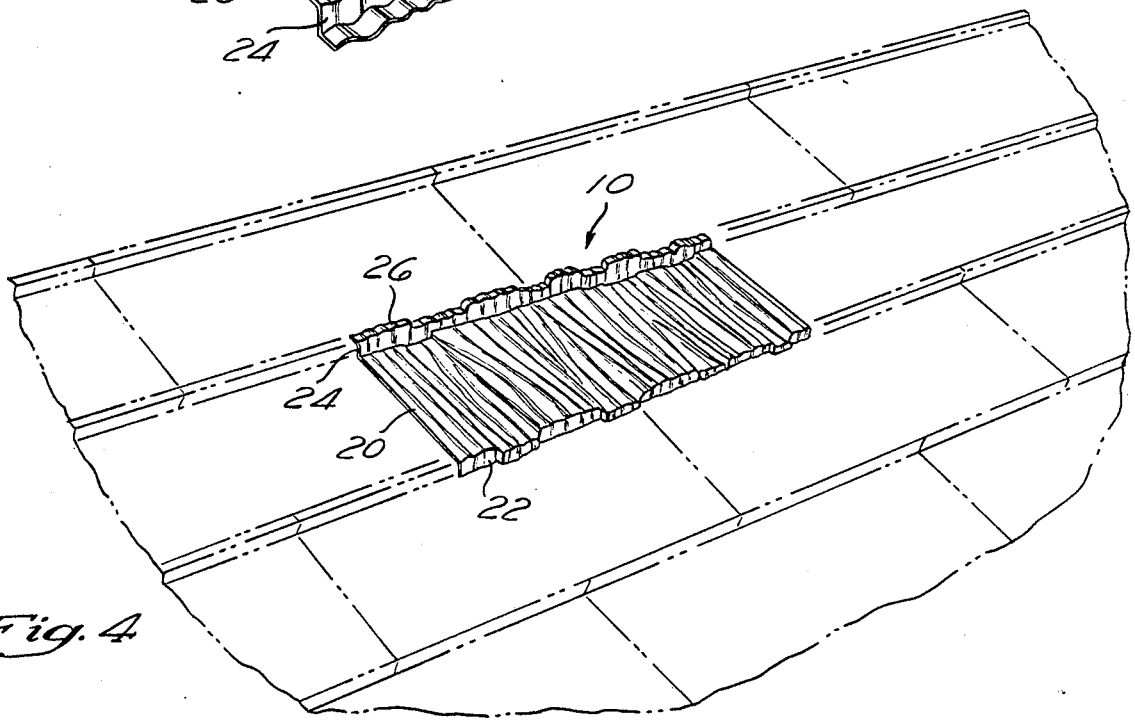
Fig. 4

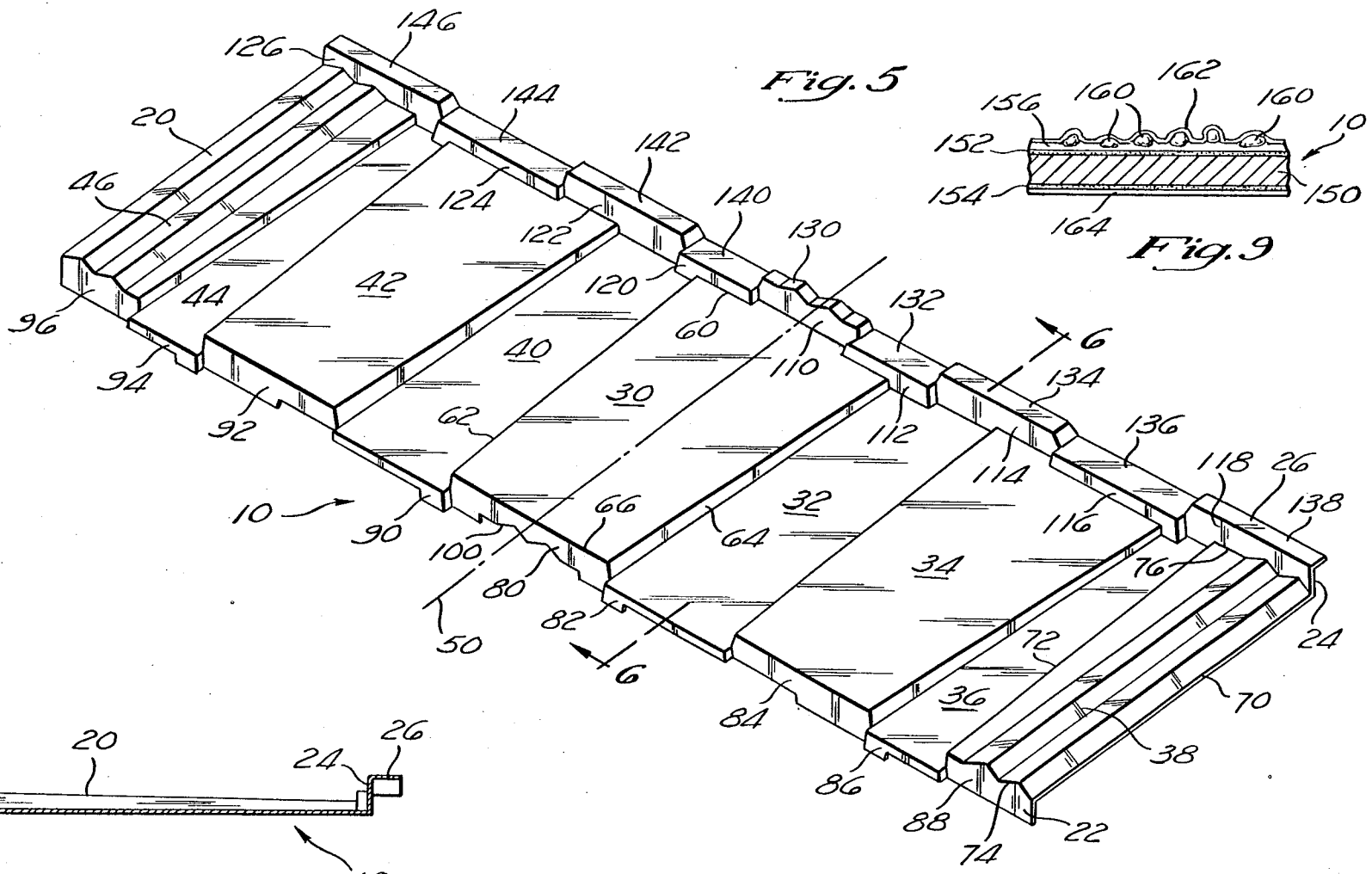
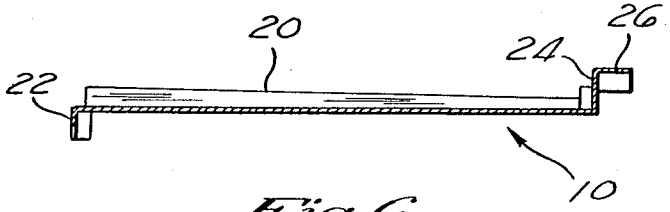
Fig. 6

Fig. 7
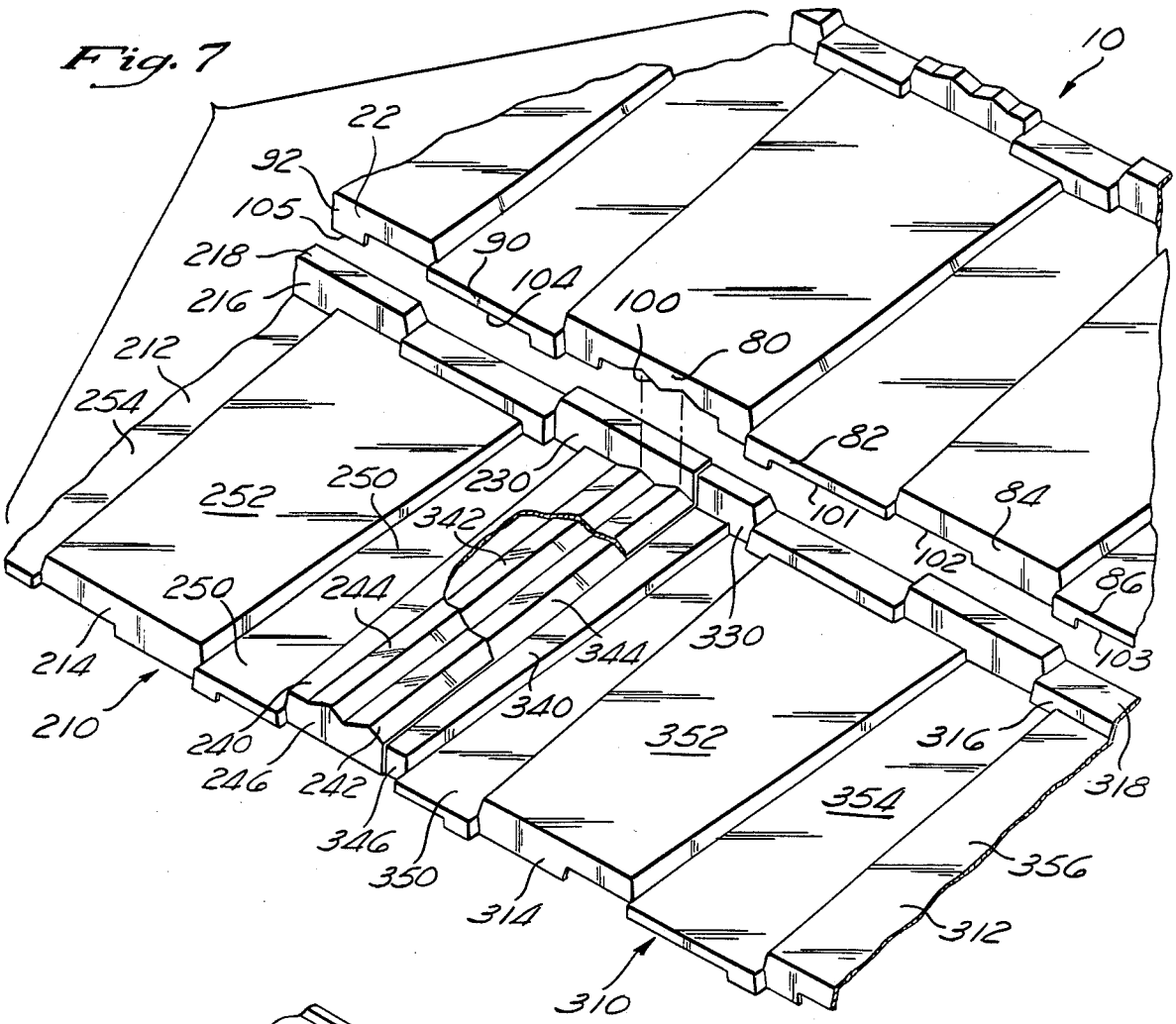
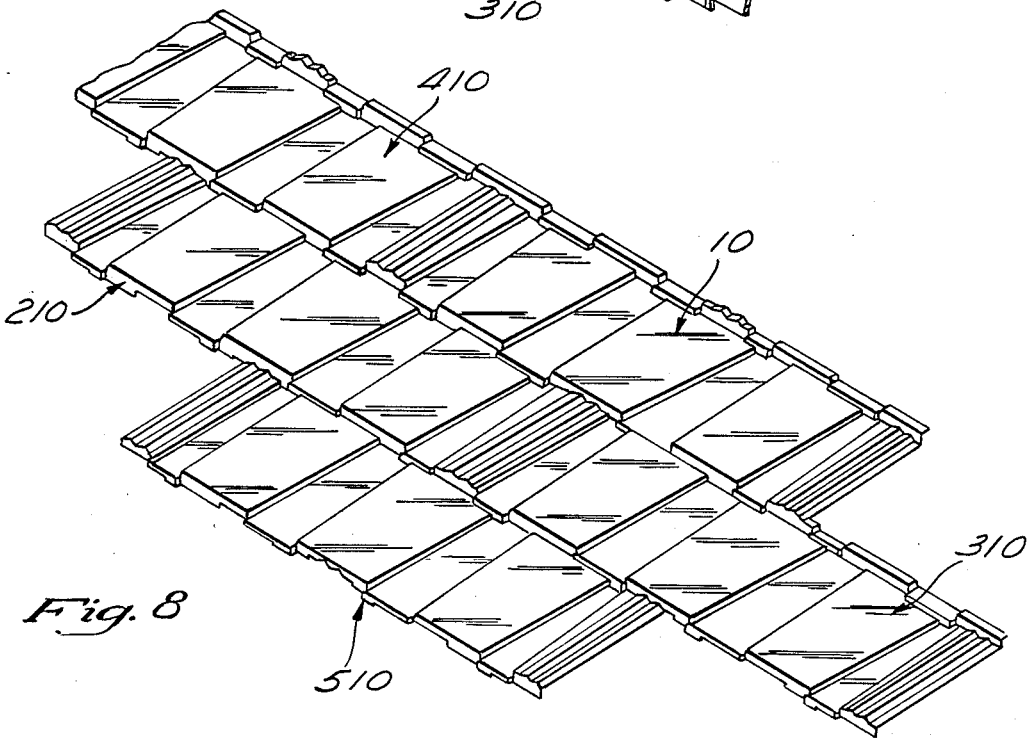
Fig. 8

ROOFING PANEL

BACKGROUND OF THE INVENTION

The present invention relates to roofing materials. In particular, the present invention relates to stamped steel panels for making a roof which simulates the appearance of a wooden shake roof.

Since time immemorial, man has been building roofs out of wood. Currently, the standard materials for constructing wood roofs are shingles, which are trapezoidal slices of wood approximately $\frac{1}{4}''$ thick, and shakes, which are trapezoidal pieces of wood approximately $\frac{5}{8}''$ to 2" thick. Both shingles and shakes are manufactured in random widths from $1\frac{1}{2}''$ to 9". The installed wooden shake or shingle roof provides a random appearance, which is highly desirable among certain segments of the population.

Wooden roofs are peculiarly susceptible to a multitude of problems. Not the least of these problems is that they tend to burn like a torch when exposed to open flame. Other undesirable characteristics of wooden roofs are that they tend to blow off in pieces, leak like a sieve and provide a fertile environment for growing fungus and other objectionable organisms. Notwithstanding these drawbacks, the appearance of a wooden roof is considered highly desirable.

Accordingly, there exists a need for a roofing material that replicates the look of wooden roofs. Standard asphalt roofing material may be made successfully to mimic the appearance of a wooden shingle roof. Asphalt material, however, is too thin to successfully replicate the appearance of a wooden shake roof. Accordingly, there exists a need for a roofing material that replicates the appearance of a wooden shake roof but is not susceptible to fire, leakage or wind damage, and does not provide an environment for growing living organisms.

SUMMARY OF THE INVENTION

The present invention is a roofing panel for installation with similar adjacent top, bottom and side panels to form a roof. Each panel has a generally rectangular panel body with an irregular surface of generally trapezoidal shake-like modules of different heights and widths. The panel body is symmetrical only about the lateral center line of the panel, which promotes the desired random appearance of a wooden shake roof. The modules at the ends of the panel surface are configured to overlap with an end module of an adjacent side panel. The front edge of the panel body has a nose flange extending downwardly therefrom. This nose flange is irregularly configured so that, in use, it is adapted to abut the panel body of an adjacent bottom panel. Extending upwardly from the rear edge of the panel body is an irregularly configured rear upstand. This upstand is adapted to mate with the nose flange rear surface of an adjacent top panel. Extending rearwardly from the top edge of the rear upstand is an irregularly configured back flange. This back flange is configured so that, in use, its top surface is adapted to mate with the bottom surface of the panel body of an adjacent top panel.

In a particularly preferred embodiment, the present invention is directed to a zinc or zinc-aluminum alloy coated steel panel further coated with a bonding agent such as a high solids styrene acrylic water miscible emulsion, which has embedded therein stone aggregate granules. In this particularly preferred embodiment, the coated panel underside is further coated with a seal coat of polyester.

Another embodiment of the present invention is a coated metal roofing panel for installation with similar adjacent top, bottom and side panels to form an easily installed, waterproof and fireproof roof that simulates the appearance of a wooden shake roof. This roofing panel has a generally rectangular panel body with an irregular main surface of adjacent, alternating, generally trapezoidal upper and lower shake-like modules of different heights and widths. This panel body is symmetrical only about the lateral center line of the panel. That is to say that the left side of the panel body is a mirror image of the right side. The modules at the ends of the panel body are configured to overlap with an end module of an adjacent side panel. Extending downwardly and generally perpendicularly from the front edge of the panel body is a nose flange, which is irregularly configured so that the area of the nose flange associated with a panel body module is displaced from the nose flange areas associated with the adjoining panel body modules. In use, the nose flange bottom edge is adapted to mate with the panel body of an adjacent bottom panel. Extending upwardly and generally perpendicularly from the rear edge of the panel body generally parallel to the nose flange is a short rear upstand. The rear upstand is irregularly configured in that areas are displaced from one another so that, in use, the front surface of the rear upstand is adapted to mate with the nose flange rear surface of an adjacent top panel. Extending rearwardly and generally perpendicularly from the top edge of the rear upstand and generally parallel to the panel body is a back flange. This back flange is irregularly configured in that areas are vertically displaced from one another so that, in use, the back flange upper surface is adapted to mate with the bottom surface of the panel body of an adjacent top panel.

In a particularly preferred embodiment, the panel body is grooved in an irregular pattern for simulating the appearance of wood.

In another embodiment, the present invention is a roofing panel for installation with other such panels to form an easily installed roof that simulates the appearance of a shake roof, the panel having a generally rectangular panel body with an upper surface formed by shake-like panel sections of different sizes. The panel sections include a central panel section having a generally trapezoidal shape with a rear edge and a pair of straight side edges converging from the rear edge towards a straight front edge which is narrower than the rear edge. Adjacent to and contiguous with the central panel section is the first side panel section which has a generally trapezoidal shape with a rear edge and a pair of straight side edges diverging from the rear edge towards a straight front edge which is wider than the rear edge and which has an upper surface which is lower than the upper surface of the central section. Laterally adjacent to and contiguous with the first section opposite the central section is a second side panel section having a generally trapezoidal shape with a rear edge and a pair of straight side edges converging towards a front edge which is narrower than the rear edge and having an upper surface which is generally level with the upper surface of the central section. Laterally adjacent to and contiguous with the second section opposite the first section is a third side panel section having a rear edge and a pair of straight side edges diverging towards a straight front edge which is wider than the rear edge and having an upper surface which is generally level with the upper surface of the first section. Laterally adjacent to and contiguous with the third section opposite the second section is an end panel section having a rear edge and a pair of straight side edges diverging towards a straight front edge which is narrower than the rear edge and having a corrugated surface. The tops of the corrugations are generally level with the upper surfaces of the central section and the second section.

BRIEF DESCRIPTION OF THE DRAWINGS

FIG. 1 is top perspective view of the roofing panel of the present invention.

FIG. 2 is a bottom perspective view of the roofing panel of FIG. 1.

FIG. 3 is an end view of the roofing panel of FIG. 1 taken along the lines 3—3.

FIG. 4 is a perspective view of the present invention as applied to a roof, showing adjacent panels in phantom.

FIG. 5 is a perspective view of an embodiment of the roofing panel of the present invention without grooves for simulating wood grain.

FIG. 6 is a cross-sectional view of the roofing panel of FIG. 5 taken along lines 6—6 of FIG. 5.

FIG. 7 is an exploded and partially sectional view showing the relationship between installed panels of the present invention;

FIG. 8 is a perspective view showing a roofing panel of the present invention installed with adjacent top, bottom and side panels.

FIG. 9 is a typical cross-sectional detail view of a preferred embodiment of the roofing panel of the present invention.

DETAILED DESCRIPTION OF THE PREFERRED EMBODIMENT

Referring to FIG. 1, a roofing panel 10, in accordance with the present invention, is shown. The roofing panel has a panel body 20 and a nose flange 22 depending perpendicularly from the front edge of the panel body 20. The panel 10 also has a rear upstand 24 projecting upwardly and perpendicularly from the rear edge of the panel body 20. The rear upstand 24 is generally parallel to the nose flange 22. Projecting rearwardly from and generally perpendicular to the rear upstand 24 and generally parallel to the panel body 20 is a back flange 26.

The relationship between the particular elements of the invention may be more clearly seen in FIG. 5. That figure reveals that the panel body 20 is made up of a series of generally trapezoidal modules 30, 32, 34, 36, 38, 40, 42, 44 and 46. It is apparent from FIG. 5 that the roofing panel 10 is symmetrical about a lateral center line 50, but is not otherwise symmetrical. The center module 30 is centrally located laterally on the panel body 20. Adjacent to the central panel 30 is the first right side module 32. Adjacent to the first right side module 32 and opposite the central module 30 is the second right side module 34. Adjacent the second right side module 34 and opposite the first right side module 32 is the third right side module 36. Adjacent the third right side module 36 and opposite the second right side module 34 is the right end module 38. Adjacent the center module 30 and opposite the first right side module 32 is the first left side module 40. Adjacent the first left side module 40 and opposite the center module 30 is the second left side module 42. Adjacent the second left side module 42 and opposite the first left side module 40 is the third left side module 44. Adjacent the third left side module 44 and opposite the second left side module 42 is the left end module 46.

First right and left side modules 32, 40 are symmetrical about transverse center line 50. Similarly, second right and left side modules 34, 42 are symmetrical about transverse center line 50. Also, third right and left side modules 36, 44 are symmetrical about transverse center line 50. Finally, right and left end modules 38, 46 are symmetrical about transverse center line 50.

Each module of the panel body 20 is generally trapezoidal in shape. For example, center module 30 has a rear edge 60 from which side edges 62, 64 converge towards front edge 66, which is narrower than rear edge 60. Center module 30 is not precisely trapezoidal as rear edge 60 is not linear. Edges 62, 64 and 66 are, however, linear. Center module 30 may, therefore, be described as generally trapezoidal. The same may be said for modules 32, 34, 36, 40, 42 and 44. Similarly, right and left end modules 38, 46 are trapezoidal only if viewed in the plan view. For example, right end module side edges 70, 72 are linear, but right end module front and rear edges 74, 76 are linear only in plan view. The end modules may also, therefore, be described as generally trapezoidal.

Depending from the front edge of the panel body 20 is the nose flange 22. The nose flange 22 extends laterally across the front edge of the panel body 20 and is divided into a series of areas or segments 80, 82, 84, 86, 88, 90, 92, 94 and 96.

Center nose flange segment 80 has a generally straight top edge 66 which is generally collinear with the center module front edge 66. The center nose flange segment bottom edge 100 is not straight, but is configured to mate with, or abut, the overlapped right end module 38 of an adjacent lower left side panel 210 and left end module 46 of an adjacent lower right end module 310 at, for example, the right end module rear edge 76.

The adjacent first right side nose flange segment 82 is offset, both vertically and forwardly, from the center nose flange segment 80. Likewise, the second right side nose flange segment 84 is offset, both vertically and rearwardly, from the first right side nose flange segment 82. Moreover, the third right side nose flange segment 86 is offset, both vertically and forwardly, from the second right side nose flange segment 84. Finally, the right end nose flange segment 88 is offset both vertically and rearwardly, from the third right side nose flange segment 86. The center nose flange segment 80 is in the same plane as the second right side nose flange segment 84 and the right end nose flange segment 88. On the other hand, the first right side nose flange segment 82 is in the same plane as the third right side nose flange segment 86. This same alternating arrangement is repeated on the opposite side of the transverse center line 50, so that the first left side nose flange segment 90 is vertically and forwardly displaced from the center nose flange segment 80, the second left side nose flange segment 92 is vertically and rearwardly displaced from the first left side nose flange segment 90, the third left side nose flange segment 94 is vertically and forwardly displaced from the second left side nose flange segment 92, and the left end nose flange segment 96 is vertically and rearwardly displaced from the third left side nose flange segment 94.

With the exception of right and left end nose flange segments 88, 96, the top edges of the nose flange segments are generally straight and collinear with the front edges of their associated panel body modules. On the other hand, with the exception of the right and left end nose flange segments 88, 96, the bottom edges of the nose flange segments are generally not straight, but are designed to abut or mate with the rear edges of adjacent body modules of an adjacent lower panel. The nose flange segments extend downwardly and generally perpendicularly from their associated panel body modules.

Extending upwardly from and generally perpendicular to the panel body 20 is the rear upstand 24. Rear upstand 24 is divided into a series of segments, including center upstand segment 110, first, second and third right side upstand segments 112, 114 and 116, right end upstand segment 118, first, second and third left side upstand segments 120, 122 and 124, and left end upstand segment 126. As is shown in FIG. 5, first right and left side upstand segments 112, 120 are forwardly displaced from center upstand segment 110, which is laterally centrally positioned at the rear edge of the central panel section 30. The first right and left side upstand segments 112, 120 are vertically shorter than the central upstand segment 110 and extend beyond the side edges 62, 64 of the central panel section 30 and onto the adjacent left and right first panel sections 32 and 40. Second right side upstand segment 114 is rearwardly displaced from first right side upstand segment 112. Third right side upstand segment 116 is forwardly displaced from second right side upstand segment 114. Right end upstand segment 118 is rearwardly displaced from third right side upstand segment 116. The same arrangement is repeated on the opposite side of the transverse center line 50. In addition to each upstand segment being displaced from an adjacent upstand segment, each upstand segment except the central upstand segment extends across the adjacent edge of a contiguous pair of adjacent panel sections. For example, first right side upstand segment 112 extends across the adjacent edge 64 of a contiguous pair of adjacent panel sections 30 and 32.

It will also be appreciated from FIG. 5 that the shapes of certain nose flange segments corresponds to the shapes of certain rear upstand segments. For example, front nose piece segment 82 is the same shape as rear upstand segment 124. The same holds true for front nose piece segments 84, 86, 90, 92 and 94 and their corresponding rear upstand segments 122, 120, 116, 114 and 112. The shape of right and left end nosepiece segments 88 and 96 corresponds to the shape of a portion of central upstand segment 110.

Extending rearwardly from and perpendicular to the upstand 24 is the back flange 26. The back flange 26 is, in turn, divided into discrete segments. With the exception of center back flange segment 130, the back flange segments are generally planar and parallel to the panel body 20. As can be seen in FIG. 5, the first right side back flange segment 132 is vertically displaced from the center back flange segment 130. Likewise, the second right side back flange segment 134 is vertically displaced from first right side back flange segment 132, but is generally level with center back flange segment 130. Third right side back flange segment 136 is vertically displaced from second right side black flange segment 134, but is generally level with first right side back flange segment 132. Right end back flange segment 138 is vertically displaced from third right side back flange segment 136, but is generally level with second right side back flange segment 134. This arrangement is repeated on the opposite side of the transverse center line 50, so that center back flange segment 130, first left side back flange segment 140, second left side back flange segment 142, third left side back flange segment 144 and left end back flange segment 146 alternate their vertical heights.

A significant feature of these panels is that they self nest. That is, a panel will stack directly on top of a similar panel. Stacking is facilitated by the inwardly sloping side edges of each raised panel module, the front-to-back divergence of each raised panel module, and the symmetry about the panel lateral center line. Self nesting allows very compact storage and shipping and substantially reduces the cost thereof.

FIG. 6 shows the relationship between the displaced panel body modules, nosepiece segments, rear upstand segments, and back flange segments in a cross-sectional view of the panel 10. As can be seen from FIG. 6, the cross-sectional thickness of the panel 10 is substantially uniform throughout.

Referring to FIG. 9, roofing panel 10 may be advantageously constructed from sheets of galvanized or zinc-aluminum alloy coated steel. A particularly preferred embodiment is sheet steel having a coating of zinc aluminum alloy. A preferred thickness is 0.017", having 0.001" per side of zinc-aluminum alloy coating. Such a material may be obtained from Bethlehem Steel under the trademark GALVALUME. One of ordinary skill in the art will recognize that other materials may be substituted for galvanized or zinc-aluminum alloy coated steel to achieve a durable, water-resistant and fire-resistant roof. For example, a composite material could be used. Fiberglass could be employed, but its relatively high cost is a drawback. The particularly preferred materials may be stamped from sheet material. The inventor has found that an embodiment of the particularly preferred embodiment described herein may be formed from sheet material in one stamping operation with approximately 160 tons of force.

The panels may be advantageously formed using mating dies of hardened tool steel and conventional stamping techniques. Because of conventional considerations in stamping, it will be understood by those of skill in the art that the top and bottom radii limits should be on the order of ⅛" to 1½". Vertical surfaces should be avoided to allow release of the workpiece from the dies. Therefore, care should be taken to insure adequate draft angles on all surfaces. Also, it will be appreciated that the designer of such a panel would want to make as many of the surfaces as near to horizontal as possible to facilitate application of the various coatings and aggregate material applied to the panel.

The galvanized steel 150 is preferably coated with a chromate epoxy primer preferably both on the top 152 and bottom 150. A particularly preferred primer is strontium chromate epoxy primer.

The underside of the roofing panel 10 may be coated with a seal coat of polyester 164. This seal coat 164 will seal the primer 154 so as to prevent moisture ingress into the porous primer 154.

On the top surface of the roofing panel 10, the primer 152 is coated with a high solid styrene acrylic water miscible emulsion 156. This coating serves as a bonding matrix for holding the stone aggregate granules 160 to the panel 10. This emulsion 156 is also highly corrosion-resistant.

While the emulsion 156 is still wet, stone aggregate granules 160 are applied evenly across the top roof panel surface. These stone aggregate granules 160, which are crushed natural stone that has been washed and graded (and may be advantageously colored), provide a total barrier to ultraviolet light. This barrier to ultraviolet light prevents degradation of the roof coating and substantially lengthens the life of the roofing panel 10. Suitable stone aggregate granules 160 may be obtained from the 3M Company under the trademark STONE CHIP.

A final coat or overglaze 160 may be sprayed over the stone aggregate granules after they have been applied. This thin, sprayed-on coating holds the stone aggregate granules 160 and bonding matrix 156 in place during the drying process. Many suitable overglaze materials are available, including acrylic emulsions.

The foregoing details of the construction of roofing panels are well-known to those of ordinary skill in the art and need no further explanation. One of ordinary skill will also appreciate that other suitable arrangements and materials may be employed in constructing roofing panels of this type.

Referring to FIG. 7, the relationship between a roofing panel 10 and adjacent lower left and right panels 210, 310 is shown in exploded perspective. Adjacent lower left panel 210 has a panel body 212, nose flange 214, rear upstand 216 and back flange 218. Similarly, adjacent lower right panel 310 has panel body 312, nose flange 314, rear upstand 316 and back flange 318.

The end modules of a panel are adapted to overlap with the end module of an adjacent panel. For example, in FIG. 7 right end panel body module 240 of the adjacent lower left panel 210 is shown overlapping left end panel body module 340 of the adjacent lower right panel 310. Adjacent lower left panel right end module 240 has first and second ribs 242, 244. Likewise, the left end module 326 of the adjacent lower right panel 340 has first and second ribs 342, 344. First rib 242 of the right end module 240 of the adjacent lower left panel 210 is shown overlapping the second rib 344 of the left end module 340 of the adjacent lower right panel 310. Similarly, second rib 244 of the right end module 240 of the adjacent lower left panel 210 is shown overlapping the first rib 342 of the left end module 340 of the adjacent lower right panel 310. This mating of the corrugated end modules 240, 340 provides a positive method for laterally locating the adjacent panels. Registration of the end modules of the adjacent panels also acts to vertically orient the adjacent panels.

Orientation of the panels in a front-to-back relation is accomplished by abutment of the adjacent lower left panel right end upstand segment 230 against the adjacent lower right panel left end upstand 330 and by abutment of the right end nose flange segment 246 of adjacent lower left panel 210 against the left end nose flange segment 346 of adjacent lower right panel 310.

Registration of a panel 10 with adjacent lower left and right panels 210, 310 is accomplished by registration of the nose flange 22 with the panel bodies 212, 312 of the adjacent lower panels 210, 310. In particular, the bottom edge 100 of the center nose flange segment 80 of the roofing panel 10 is irregularly configured to mate with the overlapped right and left end nose flange segments 240, 340, including the mating first and second ribs 242, 244, 342 and 344. The center nose flange segment bottom edge 100 is also configured to straddle and abut the rear edges of the third left and right panel body modules 250, 350. The bottom edge 101 of first right side nose flange segment 82 straddles and abuts the rear edge of adjacent lower right panel third left side module 350 and second left side module 352. The bottom edge 102 of the second right side nose flange segment 84 straddles and abuts the rear edge of adjacent lower right panel second left side module 352 and first left side module 354. The bottom edge 103 of the third right side nose flange segment 86 straddles and abuts the rear edges of the adjacent lower right panel first left side module 354 and center module 356. This same arrangement is used on the opposite side of transverse center line 50. Bottom edge 104 of first left side nose flange segment 90 straddles and abuts the rear edges of adjacent lower left panel third right side module 250 and second right side module 252. The bottom edge 105 of the second left side nose flange segment 92 straddles and abuts the rear edge of the adjacent lower left panel second right side module 252 and first right side module 254. It will be appreciated that, with the exception of the end nose flange segments 88, 96, each nose flange segment extends across a portion of two adjacent panel modules and their common edge.

The rear edge of each of the nose flange segments abuts the front edge of the associated rear upstand segment. Likewise, the back flange segments abut the underside of the associated panel segments of the adjacent panel.

A section of the installed roof is depicted in FIG. 8. A roofing panel 10 is shown installed with lower adjacent left and right panels 210, 310, an adjacent side panel 410, and another panel 510. FIG. 8 shows the attractive, random appearance obtained by the installation of the present invention.

The attractiveness of the roofing panel of the present invention, and the degree to which that panel simulates a shake roof when installed, may be enhanced by placing irregular grooves in the panel body 20 and nose flange 22. A panel 10 having such irregular grooves is shown in FIGS. 1–4. So that the rear upstand 24 and back flange 26 may mate with the grooved panel body 20 and nose flange 22 of adjacent panels, the rear upstand 24 and back flange 26 should be grooved to conform thereto. Such a panel is shown in FIG. 1. Because the panel is stamped from a flat sheet, the underside of the panel, shown in FIG. 2, will exhibit a grooved appearance similar to that of the upper side, shown in FIG. 1. The panel of FIG. 1 is installed in the same manner as that shown in FIG. 5. An installed panel with adjacent panels shown in phantom is shown in FIG. 4.

What is claimed is:

1. A panel for installation with similar adjacent top, bottom and side panels to form a roof, comprising:

a generally rectangular panel body having along its length an irregular surface of generally trapezoidal modules of different heights and widths, which surface is symmetrical only about the lateral centerline of the panel, the modules at the ends of said surface being configured to overlap with an end module of an adjacent side panel;

a nose flange extending downwardly from the front edge of said panel body and being irregularly configured so that in use the nose flange bottom edge is adapted to abut the panel body of an adjacent bottom panel;

a rear upstand extending upwardly from the rear edge of said panel body and being irregularly configured so that in use the front surface of said rear upstand is adapted to mate with the nose flange rear surface of an adjacent top panel; and a back flange extending rearwardly from the top edge of said rear upstand and being irregularly configured so that in use its top surface is adapted to mate with the bottom surface of the panel body of an adjacent top panel.

2. The panel of claim 1, wherein said panel has a substantially uniform thickness throughout.

3. The panel of claim 2, wherein said panel is formed of stamped sheet material.

4. The panel of claim 3, wherein said material is steel.

5. The panel of claim 1, wherein said panel is formed of steel.

6. The panel of claim 5, wherein said steel is coated with zinc or zinc-aluminum alloy.

7. The panel of claim 5, wherein said steel is coated with chromate epoxy resin.

8. The panel of claim 7, wherein said coated panel underside is further coated with a seal coat of polyester.

9. The panel of claim 7, wherein said coated panel top surface is further coated with a bonding matrix.

10. The panel of claim 9, wherein said bonding matrix is a high solids styrene acrylic water miscible emulsion.

11. The panel of claim 9, wherein said matrix has embedded therein stone aggregate granules.

12. A panel for installation with similar adjacent top, bottom and side panels to form a roof, comprising:

a generally rectangular panel body having along its length an irregular surface of generally trapezoidal modules of different heights and widths having a generally linear front edge, generally linear sides and a non-linear rear edge, the modules at the end of said surface being configured to overlap with an end module of an adjacent side panel;

a nose flange extending downwardly from the front edge of said panel body and being irregularly configured so that in use the nose flange bottom edge is adapted to abut the panel body of an adjacent bottom panel;

a rear upstand extending upwardly from the rear edge of said panel body and being irregularly configured so that in use the front surface of said rear upstand is adapted to mate with the nose flange rear surface of an adjacent top panel; and a back flange extending rearwardly from the top edge of said rear upstand and being irregularly configured so that in use its top surface is adapted to mate with the bottom surface of the panel body of an adjacent top panel.

13. A coated metal roofing panel for installation with similar adjacent top, bottom and side panels to form an easily installed, waterproof and fireproof roof that simulates the appearance of a wooden shake roof, comprising:

a generally rectangular panel body having an irregular main surface of adjacent, alternating, generally trapezoidal upper and lower shake-like modules of different heights and widths being symmetrical only about the lateral centerline of the panel, the modules at the ends thereof being configured to overlap with an end module of an adjacent side panel;

a nose flange extending downwardly and generally perpendicularly from the front edge of said panel body and being irregularly configured so that the nose flange segment associated with a panel body module is displaced, both vertically and front to back, from the nose flange segment associated with the adjoining panel body modules and so that in use the nose flange bottom edge is adapted to mate with the panel body of an adjacent bottom panel;

a short rear upstand extending upwardly and generally perpendicularly from the rear edge of said panel body and generally parallel to said nose flange, said rear upstand being irregularly configured in that adjacent segments are displaced, both vertically and front to back, from one another so that in use the front surface of said rear upstand is adapted to mate with the nose flange rear surface of an adjacent top panel; and a back flange extending rearwardly and generally perpendicularly from the top edge of said rear upstand and generally parallel to said panel body, said back flange being irregularly configured in that adjacent segments are vertically displaced from one another so that in use its upper surface is adapted to mate with the bottom surface of the panel body of an adjacent top panel.

14. The roofing panel of claim 13, wherein said panel body is grooved in an irregular pattern for simulating the appearance of wood.

15. A roofing panel for installation with other such panels to form an easily installed roof that simulates the appearance of a shake roof, comprising a generally rectangular panel body having an upper surface formed by shake-like panel sections of different sizes, said sections including:

a central panel section having a generally trapezoidal shape with a rear edge and a pair of straight side edges converging from the rear edge towards a straight front edge which is narrower than the rear edge;

a first side panel section laterally adjacent to and contiguous with said central section, said first section having a generally trapezoidal shape with a rear edge and a pair of straight side edges diverging from the rear edge towards a straight front edge which is wider than the rear edge of said first section, said first section having an upper surface which is lower than the upper surface of said central section;

a second side panel section laterally adjacent to and contiguous with said first section opposite said central section, said second section having a generally trapezoidal shape with a rear edge and a pair of straight side edges converging towards a front edge which is narrower than the rear edge of said second section, said second section having an upper surface which is generally level with the upper surface of said central section;

a third side panel section laterally adjacent to and contiguous with said second section opposite said first section, said third section having a rear edge and a pair of straight side edges diverging towards a straight front edge which is wider than the rear edge of said third section, said third section having an upper surface which is generally level with the upper surface of said first section; and an end panel laterally adjacent to and contiguous with said third section opposite said second section, said end section having a rear edge and a pair of straight side edges converging towards a straight front edge which is narrower than the rear edge of said end section, said end section having an upper surface which is ribbed between the upper and lower edges of said end section and is generally level with the upper surfaces of said central section and said second section, wherein said panel body is symmetrical laterally only about a central line.

16. In a coated metal roofing panel for installation with similar adjacent top, bottom and side panels to form an easily installed, waterproof and fireproof roof, said panel having a generally rectangular nonplanar panel body with a surface of areas of different heights and widths and with ends configured to overlap with the end of an adjacent side panel, a nonplanar nose flange extending downwardly and generally perpendicularly from the front edge of said panel body configured so that the nose flange bottom surface abuts the panel body of an adjacent bottom panel, a rear upstand extending upwardly and generally perpendicularly from the rear edge of said panel body and generally parallel to said nose flange configured so that the front surface thereof abuts the rear surface of the nose flange of an adjoining top panel, and a back flange extending rearwardly and generally perpendicularly from the top edge of said rear upstand and generally parallel to said panel body configured so that the upper surface thereof abuts the bottom surface of the panel body of the adjacent top panel, the improvement comprising:

said panel body areas of different heights and widths being an irregular surface of adjacent alternating trapezoidal upper and lower modules symmetrical only about the lateral centerline of the panel;

said nose flange being irregularly configured so that the area thereof associated with a main portion module is displaced from the areas thereof associated with adjacent modules;

said rear upstand being irregularly configured in that areas are displaced from one another; and said back flange being irregularly configured in that adjacent areas associated with the displaced areas of said rear upstand are displaced.

17. A roofing panel for installation with other such panels to form an easily installed roof that simulates the appearance of a shake roof, comprising a generally rectangular panel body having an upper surface formed by shake-like panel sections of different sizes, said sections including:

a central panel section having a generally trapezoidal shape with a rear edge and a pair of straight side edges converging from the rear edge towards a straight front edge which is narrower than the rear edge;

a first side panel section laterally adjacent to and contiguous with said central section, said first section having a generally trapezoidal shape with a rear edge and a pair of straight side edges diverging from the rear edge towards a straight front edge which is wider than the rear edge of said first section, said first section having an upper surface which is lower than the upper surface of said central section;

a second side panel section laterally adjacent to and contiguous with said first section opposite said central section, said second section having a generally trapezoidal shape with a rear edge and a pair of straight side edges converging towards a front edge which is narrower than the rear edge of said second section, said second section having an upper surface which is generally level with the upper surface of said central section;

a third side panel section laterally adjacent to and contiguous with said second section opposite said first section, said third section having a rear edge and a pair of straight side edges diverging towards a straight front edge which is wider than the rear edge of said third section, said third section having an upper surface which is generally level with the upper surface of said first section; and an end panel laterally adjacent to and contiguous with said third section opposite said second section, said end section having a rear edge and a pair of straight side edges converging towards a straight front edge which is narrower than the rear edge of said end section, said end section having an upper surface which is ribbed between the upper and lower edges of said end section and is generally level with the upper surfaces of said central section and said second section, wherein said panel body is symmetrical laterally about a central line and includes side sections and an end section extending from the other side of said central section, including first, second and third side sections and an end section, so that said panel body has a central panel section, right first, second and third panel sections, a right end panel section, left first, second and third panel sections, and a left end panel section, and wherein said end panel sections are wider than said third panel sections, said first panel sections are wider than said end panel sections, said second panel sections are wider than said first panel sections and said central panel section is wider than either of said second panel sections.

18. A roofing panel for installation with other such panels to form an easily installed roof that simulates the appearance of a shake roof, comprising a generally rectangular panel body having an upper surface formed by shake-like panel sections of different sizes, said sections including:

a central panel section having a generally trapezoidal shape with a rear edge and a pair of straight side edges converging from the rear edge towards a straight front edge which is narrower than the rear edge;

a first side panel section laterally adjacent to and contiguous with said central section, said first section having a generally trapezoidal shape with a rear edge and a pair of straight side edges diverging from the rear edge towards a straight front edge which is wider than the rear edge of said first section, said first section having an upper surface which is lower than the upper surface of said central section;

a second side panel section laterally adjacent to and contiguous with said first section opposite said central section, said second section having a generally trapezoidal shape with a rear edge and a pair of straight side edges converging towards a front edge which is narrower than the rear edge of said second section, said second section having an upper surface which is generally level with the upper surface of said central section;

a third side panel section laterally adjacent to and contiguous with said second section opposite said first section, said third section having a rear edge and a pair of straight side edges diverging towards a straight front edge which is wider than the rear edge of said third section, said third section having an upper surface which is generally level with the upper surface of said first section; and an end panel laterally adjacent to and contiguous with said third section opposite said second section, said end section having a rear edge and a pair of straight side edges converging towards a straight front edge which is narrower than the rear edge of said end section, said end section having an upper surface which is ribbed between the upper and lower edges of said end section and is generally level with the upper surfaces of said central section and said second section, and a rear upstand extending upwardly and generally perpendicularly from the rear edge of said panel body and extending laterally along the rear edge of the panel body, said upstand being divided into a row of upstand segments including a central upstand segment, with each upstand segment being displaced from an adjacent upstand segment and with each upstand segment except the central upstand segment extending across the adjacent edge of a contiguous pair of adjacent panel sections.

19. A roofing panel for installation with other such panels to form an easily installed roof that simulates the appearance of a shake roof, comprising a generally rectangular panel body having an upper surface formed by shake-like panel sections of different sizes, said sections including:

a central panel section having a generally trapezoidal shape with a rear edge and a pair of straight side edges converging from the rear edge towards a straight front edge which is narrower than the rear edge;

a first side panel section laterally adjacent to and contiguous with said central section, said first section having a generally trapezoidal shape with a rear edge and a pair of straight side edges diverging from the rear edge towards a straight front edge which is wider than the rear edge of said first section, said first section having an upper surface which is lower than the upper surface of said central section;

a second side panel section laterally adjacent to and contiguous with said first section opposite said central section, said second section having a generally trapezoidal shape with a rear edge and a pair of straight side edges converging towards a front edge which is narrower than the rear edge of said second section, said second section having an upper surface which is generally level with the upper surface of said central section;

a third side panel section laterally adjacent to and contiguous with said second section opposite said first section, said third section having a rear edge and a pair of straight side edges diverging towards a straight front edge which is wider than the rear edge of said third section, said third section having an upper surface which is generally level with the upper surface of said first section; and an end panel laterally adjacent to and contiguous with said third section opposite said second section, said end section having a rear edge and a pair of straight side edges converging towards a straight front edge which is narrower than the rear edge of said end section, said end section having an upper surface which is ribbed between the upper and lower edges of said end section and is generally level with the upper surfaces of said central section and said second section, wherein said panel body is symmetrical laterally about a central line and includes side sections and an end section extending from the other side of said central section, including first, second and third side sections and an end section, so that said panel body has a central panel section, right first, second and third panel sections, a right end panel section, left first, second and third panel sections, and a left end panel section, and including a rear upstand extending upwardly and generally perpendicularly from the rear edge of said panel body and extending laterally along the rear edge of the panel body, said upstand being divided into a row of upstand segments including a central upstand segment, with each upstand segment being displaced from an adjacent upstand segment and with each upstand segment except the upstand segment extending across the adjacent edge of a contiguous pair of adjacent panel sections, wherein said central upstand segment is laterally centrally positions at the rear edge of said central panel section and is narrower than the rear edge of said central panel section, and said central panel section having a vertically shorter first side upstand segment on each side of said central upstand segment, said left and right first upstand segments each extending respectively beyond a side edge of said central panel section and onto the adjacent left and right first panel sections.

20. The panel of claim 19, wherein said right end panel section and said right third panel section having lower surfaces on the front end thereof adapted to fit onto the upper edge of said central upstand segment and adjacent left first upstand segment of another one of said panels.

21. The panel of claim 20, wherein said panel body has at the front edge thereof a depending nose flange divided into a series of adjacent nose flange segments associated with adjacent panel body section, each of said nose flange segments being displaced from an adjacent nose flange segment, the intersection between a panel body section and its associated nose flange segment defining a straight line.

22. The panel of claim 21, wherein said panel has a thin cross-section such that the rear surface of a nose flange segment and the front end of the underside of the panel body section associated with said nose flange segment are shaped as their front and upper surfaces, respectively, and are shaped to fit over an upstand segment and the back flange segment associated therewith of a panel to be positioned in use beneath and below said panel and laterally offset from said panel by a distance of about one-half the width of said panel.

23. An improved roofing panel, comprising:

a substantially rectangular panel body;

a nose flange extending downwardly from the front edge of said panel body, said nose flange being divided into discrete segments including a central nose flange segment and first, second and third right side nose flange segments;

a rear upstand extending parallel to said nose flange and upwardly from the rear edge of said panel body, said rear upstand being divided into discrete segments including a central upstand segment and first, second and third left side upstand segments, wherein the first right side nose flange segment has a shape substantially the same as the third left side upstand segment and different from the first and second left side upstand segments, the second right side nose flange segment has a shape substantially the same as the second left side upstand segment and different from the first and third left side upstand segments, and the third right side nose flange segment has a shape substantially the same as the first left side upstand segment and different from the second and third left side upstand segments.

* * * * *